United States Patent [19]

Pinney

[11] Patent Number: 4,775,060

[45] Date of Patent: Oct. 4, 1988

[54] ANIMAL STRAW HOLDER

[76] Inventor: Tom Pinney, 3400 State Ave., Kansas City, Kans. 66102

[21] Appl. No.: 95,050

[22] Filed: Sep. 9, 1987

[51] Int. Cl.[4] ..... A47G 19/22; A47G 21/18; A47G 23/00

[52] U.S. Cl. ..... 215/100 R; 215/1 A; 220/90.6; 229/103.1; 239/33

[58] Field of Search ..... 215/100 R, 1 A; 220/90.6, 85 D; 239/33; D7/75; 229/103.1

[56] References Cited

U.S. PATENT DOCUMENTS

| | | | |
|---|---|---|---|
| D. 163,100 | 5/1951 | Dinhofer . | |
| D. 163,101 | 5/1951 | Dinhofer . | |
| D. 169,241 | 4/1953 | Dinhofer . | |
| D. 169,242 | 4/1953 | Dinhofer . | |
| D. 182,721 | 5/1958 | Howes . | |
| D. 240,789 | 8/1976 | Frumkin . | |
| 269,909 | 1/1883 | Armstrong . | |
| 344,567 | 6/1886 | Coleman | 215/100 R |
| 485,510 | 11/1892 | Staren . | |
| 858,393 | 7/1907 | Horner . | |
| 2,052,496 | 8/1956 | Stassi . | |
| 2,070,495 | 2/1937 | Strutz et al. | 215/100 R |
| 2,085,661 | 6/1937 | Janowski . | |
| 2,370,931 | 3/1945 | Bogin et al. | 239/33 X |
| 2,460,542 | 2/1949 | Smith | 239/33 X |
| 2,469,292 | 5/1949 | Cornwell . | |
| 2,546,122 | 3/1951 | Goldfarb . | |
| 2,557,411 | 6/1951 | Butsch | 215/100 R X |
| 2,594,896 | 4/1952 | Feldman . | |
| 2,619,770 | 12/1952 | Dinhofer . | |
| 4,196,747 | 4/1980 | Quigley et al. | 239/33 X |
| 4,579,281 | 4/1986 | Karterman | 239/33 X |

FOREIGN PATENT DOCUMENTS

| | | | |
|---|---|---|---|
| 703129 | 2/1965 | Canada | 215/100 R |

*Primary Examiner*—Stephen Marcus
*Assistant Examiner*—Sue A. Weaver
*Attorney, Agent, or Firm*—Michael Yakimo, Jr.

[57] ABSTRACT

A straw guide having a body portion for suspension along the outside of a drinking glass. The body portion includes upper and lower zones of contact conformed to respectively receive the rim of the glass and the outside sidewall therein. The zones of contact releasably affix the body on the outside of the glass in a manner to preclude any undesirable wobble/spatial displacement between the guide and the glass. An aperture in the body allows for extension of an angled drinking straw therethrough and into the inside of the glass.

7 Claims, 2 Drawing Sheets

ANIMAL STRAW HOLDER

BACKGROUND OF THE INVENTION

This invention pertains to a straw guide and more particularly to an ornamental holder/drinking straw combination used in conjunction with the drinking of liquids from a tumbler.

This invention further pertains to the configuration of the ornamental holder by which it can be releasably combined with a drinking glass/tumbler without the danger of accidental tipping or other undesirable displacement of the glass and the liquid therein.

Various prior drinking straw apparatus have attempted to present an ornamental, unique appearance to the drinking straw in order to encourage children to drink liquids, e.g., milk, from a drinking glass. Accordingly, various novelty straws have eye-appealing configurations have been designed for use with a drinking glass. Many of these prior straw guides are not easily releasably attached to the glass which delimits their unsupervised use by children. Upon such use, whether upon attachment or release, there is the possibility of accidental displacement of the straw guide within the glass and a subsequent accidental tipping thereof. Although some devices have attempted to provide a releasable combination of the straw guide with the glass, such devices were either clamped to the glass or presented a cover for the glass so to hold the straw in place. Although assumably effective in their operation, such devices tended to make the glass top heavy or were not easily engageable with the glass. Such limitations reduced the probability of effective and continuous use of the straw guide with the glass. Also, these devices did not address the ability to easily displace a straw within the glass so that the straw could be used with either tall or short glasses.

In response thereto I have invented a novel straw guide which generally comprises an ornamental straw guide used in conjunction with an angled straw. The ornamental guide can be of various configurations, including my now preferred animal figurines. The animal body has upper and lower, releasable points of contact with the structure of the glass such that it is easily attached to and released from the glass as well as maintained in place on the glass during use. The animal guide further includes an aperture for insertion of an angled straw therethrough, such that either the first or second angled sections of the straw can extend to the bottom of glasses having various heights. The animal guide presents clamping means in the form of curved front feet and nesting means in the form of curved rear feet or rear body portion which respectively cooperate with the rim of the glass and the sidewall thereof such that the guide is easily clamped to or released from the glass without the danger of tipping displacement. Moreover, these upper and lower points of engagement with the glass enhance the stable maintenance of the animal guide on the glass during use.

It is therefore an object of this invention to provide an ornamental straw which is releasably clamped onto a glass and released therefrom without the danger of tippage or breakage of the glass during use.

Another object of this invention is to provide a straw, as aforesaid, having a straw guide which allows the drinking straw to be placed in selectable positions within the confines of the glass depending on the various depths of the glass therein.

Still another object of this invention is to provide a straw, as aforesaid, which is releasably clamped onto the rim of the glass without the danger of tipping thereof.

A further object of this invention is to provide a straw, as aforesaid, having first and second points of combination with the glass at the top rim and lower side portion thereof.

Still another object of this invention is to provide a straw, as aforesaid, having an animal configuration on the straw guide.

A more specific object of this invention is to provide an animal straw, as aforesaid, with the points of contact of the animal structure being the arced front feet with the rim of the glass and the arced rear feet or arched lower body portion with a sidewall portion of the glass.

Other objects and advantages of my invention will become apparent from inspection of this entire specification inclusive of the drawings and the claims thereof.

DESCRIPTION OF THE PREFERRED EMBODIMENT

Figure 1:
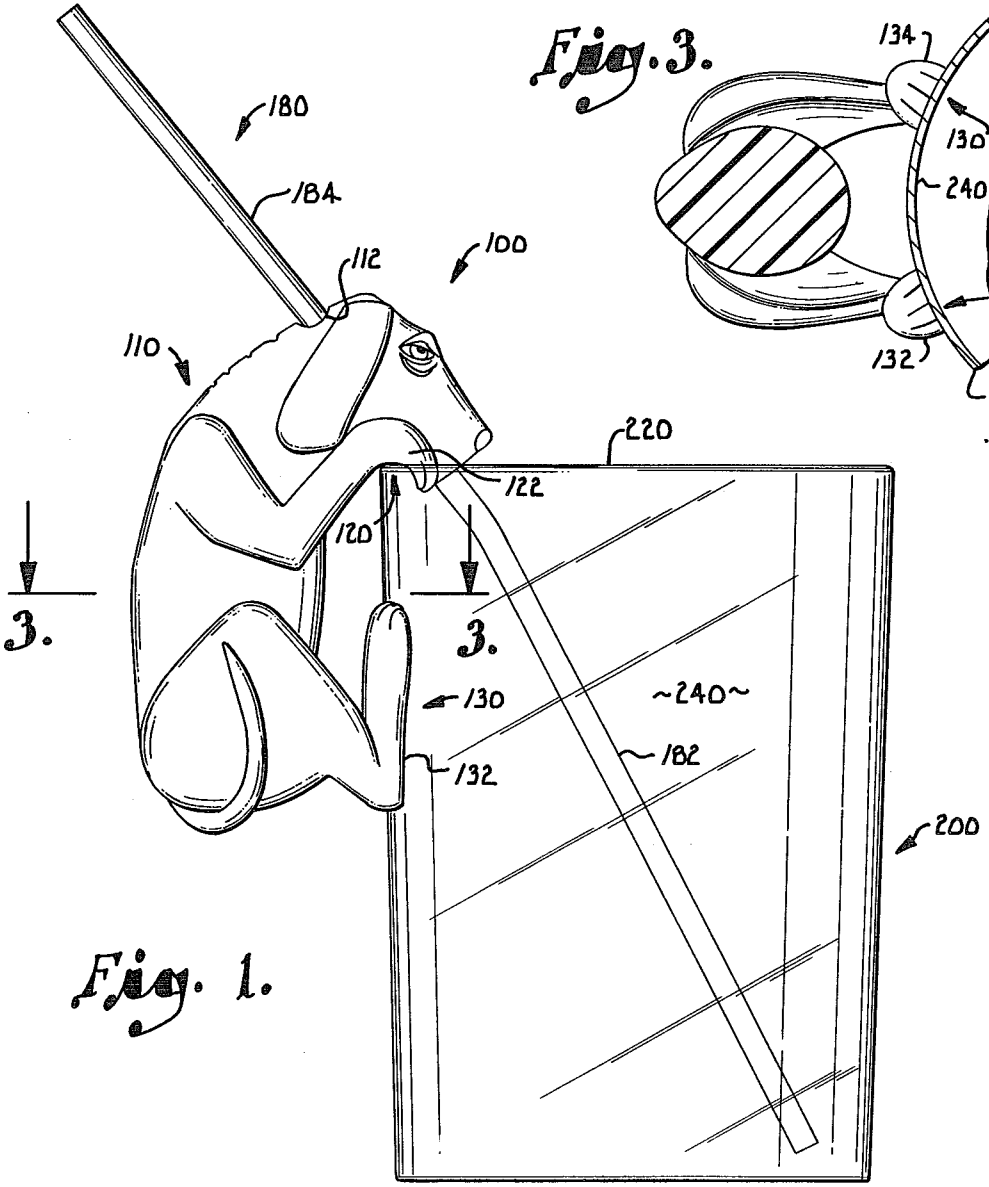
FIG. 1 is a side elevation view illustrating the ornamental animal straw in a releasably clamped position with a drinking glass.

Turning more particularly to the drawings, FIG. 1 illustrates a first embodiment 100 of the animal straw as comprising an animal straw guide 110 having an angled drinking straw 180 extending through the straw aperture 112 and into the drinking glass 200.

Figure 2:
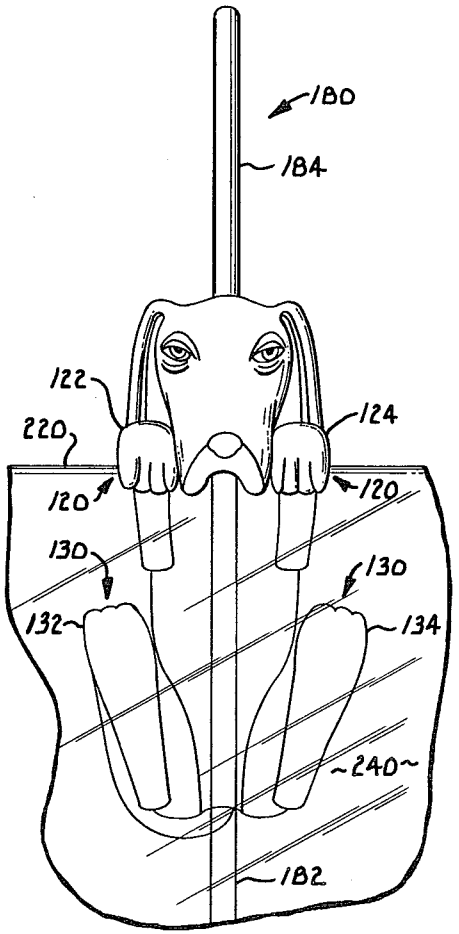
FIG. 2 is a front plan view of the animal straw, as shown in FIG. 1, as seen through the fragmentarily shown sidewall of the drinking glass.
Figure 3:
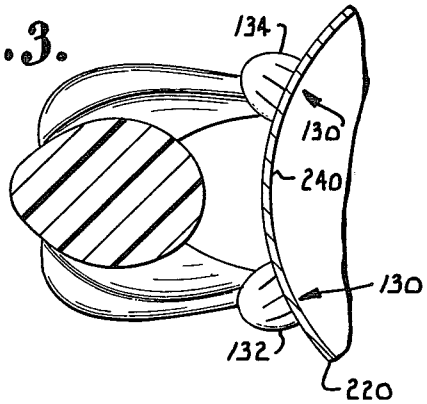
FIG. 3 is a top sectional view, taken along line 3—3 in FIG. 1, illustrating the relationship of the lower point of contact of the ornamental animal with the sidewall of the glass.

The straw guide 110 configuration may be of any desirable configuration as long as the below described upper and lower zones 120, 130 of releasable contact with the glass 200 are presented. As shown in FIG. 1 and 2 the upper zone 120 of contact with the glass 200 is established by presenting a relatively vertical curvature to the front forelimbs/feet 122, 124 of the animal. As such this curvature provides a clamping connection of the arced feet 122, 124, with the rim 220 of the glass. The lower zone 130 of contact with the glass 200 is established by presenting a relatively horizontal curvature to the lower feet 132, 134 of the animal such as to conform or nest the arced feet 132, 134 to the outside curvature of the sidewall 240 of the glass 200. As such this curvature provides a nested relationship between the arced lower body portion of the animal and the glass sidewall 240.

The generally vertically arced feet 122, 124 clamps/-grips the rim 220 of the glass and cooperates with the nested relationship established by the lower horizontally arced feet 132, 134 with the sidewall 240 of the glass 200. This cooperation diminishes undesirable wobble/spatial displacement between the clamped animal 110 and the glass as any horizontal wobble that arises at the glass rim 220 will be resisted in kind by the lower, nested feet 132, 134/glass sidewall 240 combination. This relationship aids in retaining the straw 180 in a drinking position within the confines of the glass 200.

Figure 4:
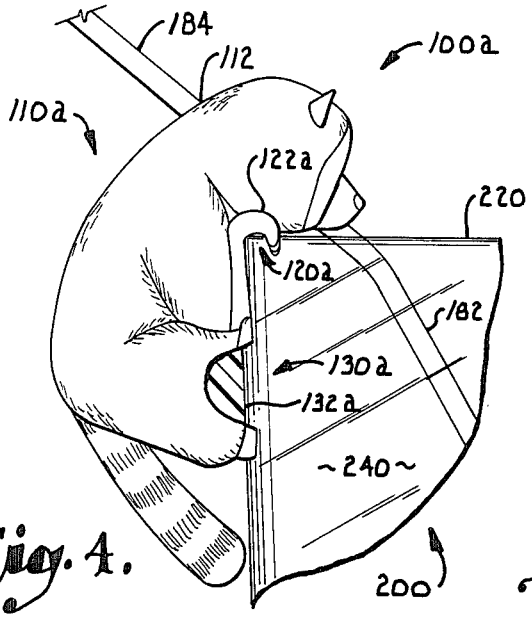
FIG. 4 is a fragementary elevation view illustrating another animal straw in a releasably clamped position on a drinking glass with a portion of the lower glass contacting foot sectioned to better show the relationship of the arched animal feet with the sidewall of the glass.
Figure 5:
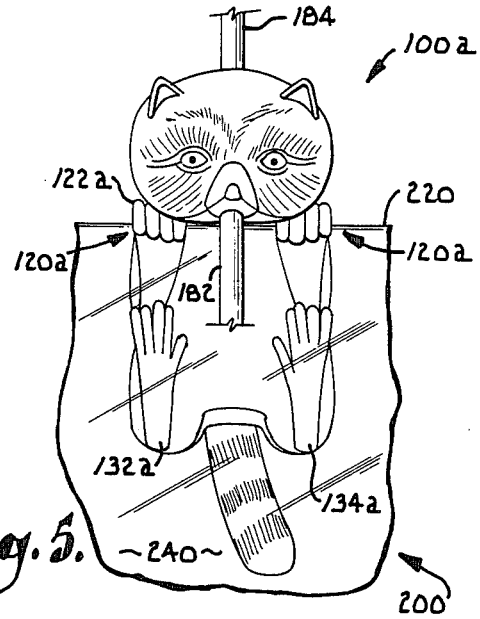
FIG. 5 is a front plan view of the animal straw, as shown in FIG. 4, as seen through the fragmentarily shown sidewall of the drinking glass.

FIG. 4 illustraates an alternative embodiment **100*a* of the animal straw with a different animal character being used for the straw guide 110*a*. Again, the upper zone of releasable clamping 120*a* with the glass 200 rim 220 is established by the arced front feet 122*a*, 124*a* of the animal. The lower zone of contact 130*a* with the glass 200 is established by the curvature on the lower feet 132*a*, 134*a* of the animal which nests the curved sidewall 240 of the glass 200 therein. As such these particularly configured zones of contact 120*a*, 130*a* cooperate with the glass 200 rim 220 and sidewall 240 clamping and nesting relationships therebetween so as to diminish undesirable wobble/spatial displacement between the straw guide 110*a* and glass as above-described. The foot 132*a* of the animal in FIG. 4 has been partially sectioned to illustrate this nesting relationship between the curvature of the back foot 132*a* of the animal and the glass sidewall 240**.

Figure 6:
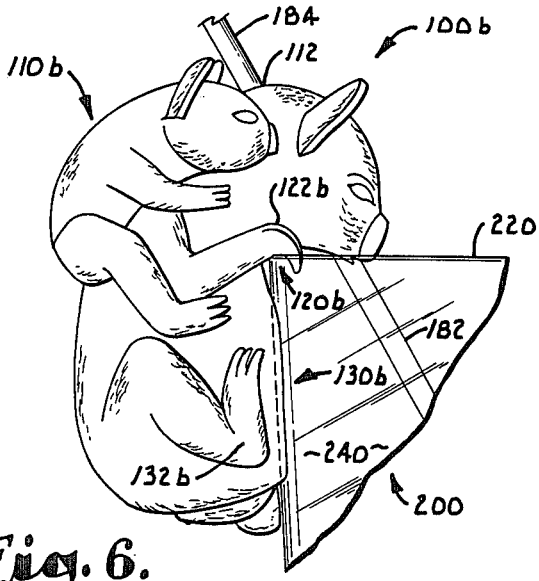
FIG. 6 illustrates another alternative embodiment of the animal straw in a releasably clamped position on a drinking glass with the lower point of contact with the sidewall of the glass being the lower body portion of the animal guide.
Figure 7:
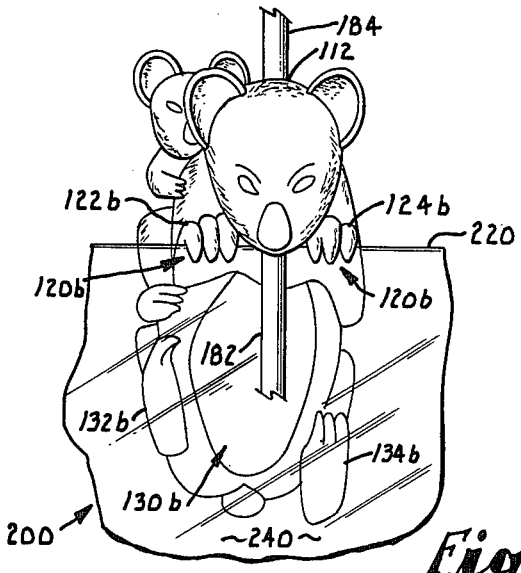
FIG. 7 is a front plan view of the animal straw, as shown in FIG. 6, as seen through the fragmentarily shown sidewall of the drinking glass.

FIGS. 6 and 7 illustrate another alternative embodiment **100*b* of the animal straw with a different animal configuration 110*b* used therein. Similar elements, corresponding to those shown in FIGS. 1 and 2, utilize identical numerals followed by the letter b. This embodiment 110*b* again illustrates the clamping engagement of the animal 100*b* with the rim 220 of the glass 200 via the curvature established on the front feet 122*b* of the animal. In this embodiment 100*b* the lower curvature is established on the lower body portion 130*b* thereof so as to present an arc having radius of curvature that conforms to the sidewall 240 of the glass 200. As such the greater arc on the body portion 130*b*, relative to the lower feet 132*b*, 134*b*, presents a more substantial nesting of the animal with the glass 200 and may be used when a top heavy figure is used such as the addition of the baby animal shown in FIG. 6**.

Figure 8:
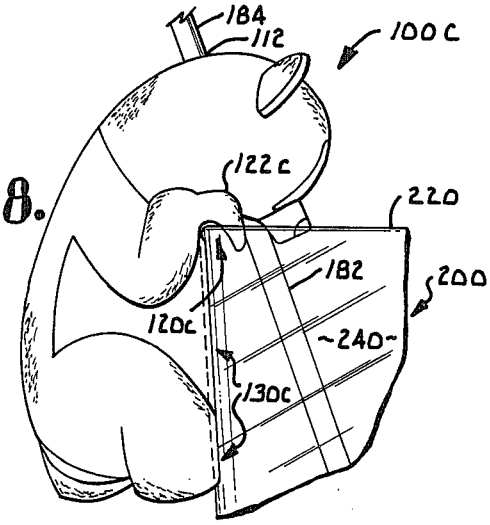
FIG. 8 illustrates another embodiment of the animal straw in a releasably clamped position on a drinking glass with the lower point of contact with the glass sidewall being the lower body portion and feet thereof.
Figure 9:
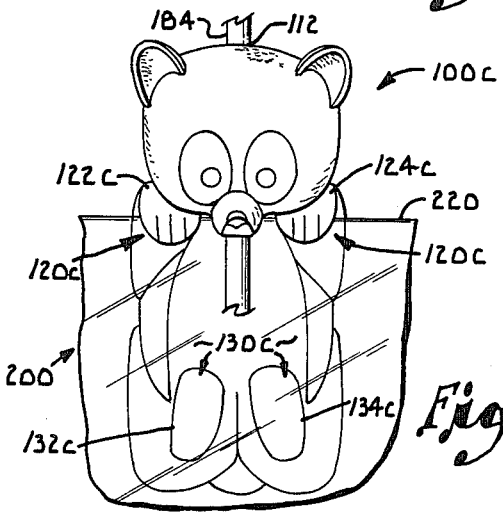
FIG. 9 is a front plan view of the animal straw, as shown in FIG. 8, as viewed through the fragmentarily shown sidewall of the drinking glass.

FIGS. 8 and 9 illustrate another animal embodiment **100*c* of the animal straw 100*c* with the upper zone of clamping contact again being established by the arced upper feet 122*c*, 124*c*/rim 220 engagement. Similar elements, corresponding to those shown in FIGS. 1 and 2, utilize identical numerals followed by the letter c. The lower zone of contact is presented by the establishment of an arc on both the lower feet 132*c*, 134*c* of the animal as well as the arc on the lower body portion 130*c* thereof. The radius of curvature of this arc conforms to the outside arc of the glass 200/sidewall 240** so as to present a nesting relationship therebetween.

In all embodiments the upper and lower arced elements are important in clamping and nesting the respective portions 220, 240 of the glass 200 so as to delimit any undesirable wobble/spatial displacement between the straw guide 110 and the glass 200. This relationship enables the straw 180 to extend through the aperture 112 with the assurance that there will be no undesirable tippage or displacement of the glass 200 as caused by the straw guide.

I have chosen to use an angled, sectioned 182,184 drinking straw 180 having a relatively longer and angled section 182 therein. As such either section may extend to the bottom of glasses having varying heights without the guide being lifted from its glass 200 engagement, particularly from the rim 220 thereof. Otherwise an unangled drinking straw or one having too long an angled section may not extend to the bottom of the glass 200; may displace the upper zone of clamping contact 120 from the rim 220 or may cause the straw to extend too far away from the animal head and cause tipping of the glass during use.

Although various forms of this invention have been illustrated and described therein, it is understood that my invention should not be limited except insofar as limited in the following claims and their functional equivalents.

What I desire to secure by Letters Patent is:

1. A straw guide comprising:

a body having an ornamental mammalian configuration for extension along a sidewall of a drinking glass;

clamping means on said body for reception of a rim of said glass therein, said clamping means comprising at least one arced forelimb on said mammalian configuration having a radius of curvature configured to engage a glass rim upon said reception, whereby to suspend said body from said glass rim;

nesting means on a lower portion of said body for reception of a portion of said sidewall of said glass therein;

an aperture in said body for extension of a drinking straw therethrough, said aperture guiding one end of said straw into said glass;

said clamping and nesting means on said body being respectively releasably engageable with said rim and sidewall of said glass whereby said body is maintained on said glass on the outside thereof.

2. The guide as set forth in claim 1 wherein said nesting means comprises:

an arced element on said lower body portion having a radius of curvature configured to engage said glass sidewall in a nested relationship therebetween, said nesting means cooperating with said clamping means to maintain said suspended body on said glass in contact with said sidewall.

3. The guide as set forth in claim 1 wherein said at least one forelimb is the front foot of said mammal.

4. The guide as set forth in claim 1 wherein said nesting means comprises:

at least one arced limb on said mammalian configuration having a radius of curvature configured to engage said glass sidewall in said nested relationship, whereby to maintain said suspended body in contact with said glass.

5. The guide as set forth in claim 4 wherein said at least one limb is the rear foot of said mammal.

6. The guide as set forth in claim 1 wherein said nesting means comprises:

an arced lower body portion on said mammalian configuration having a radius of curvature configured to engage said glass sidewall in said nested relationship, whereby to maintain said suspended body in contact with said glass.

7. In combination with a drinking glass having a top rim and sidewall, a straw guide for holding in place a drinking straw in extension into said glass comprising:

a body having an ornamental mammalian configuration for extension along said sidewall of a drinking glass;

clamping means on said body for reception of said rim of said glass therein, said clamping means comprising at least one arced forelimb on said mammalian configuration having a radius of curvature configured to engage a glass rim upon said reception, whereby to suspend said body from said glass rim;

nesting means on a lower portion of said body for reception of a portion of said sidewall of said glass therein;

an aperture in said body for extension of said drinking straw therethrough, said aperture guiding one end of said straw into said glass;

said clamping and nesting means on said body being respectively releasably engageable with said rim and sidewall of said glass whereby said body is maintained on said glass on the outside thereof with said straw within said glass.

* * * * *